United States Patent [19]

Knoll

[11] Patent Number: 4,671,425

[45] Date of Patent: Jun. 9, 1987

[54] FOOD VENDING MACHINE

[75] Inventor: Hans Knoll, Dettingen, Fed. Rep. of Germany

[73] Assignee: Tepro- Prazionstechnik GmbH, St. Georgen, Fed. Rep. of Germany

[21] Appl. No.: 719,443

[22] Filed: Apr. 3, 1985

[30] Foreign Application Priority Data

Apr. 5, 1984 [DE] Fed. Rep. of Germany ..... 3412901
Jan. 29, 1985 [DE] Fed. Rep. of Germany ..... 3502816

[51] Int. Cl.[4] ..... B67D 1/08

[52] U.S. Cl. ..... 221/8; 221/122; 221/150 HC; 99/357

[58] Field of Search ..... 62/299; 99/357; 221/2, 221/5, 8, 97–98, 101, 131–132, 134–135, 150 R, 150 HC, 150 A, 119, 121, 122

[56] References Cited

U.S. PATENT DOCUMENTS 3,333,666 8/1967 Murray et al. ..... 221/150 HC
3,386,550 6/1968 Murray et al. ..... 221/150 HC
3,482,509 12/1969 Gardner ..... 221/150 HC X
3,507,322 4/1970 Tetrick et al. ..... 62/299 X
3,928,045 12/1975 Tsunoda et al. ..... 99/330
4,398,651 8/1983 Kumpfer ..... 221/6

FOREIGN PATENT DOCUMENTS 2443200 3/1976 Fed. Rep. of Germany .
2529870 1/1977 Fed. Rep. of Germany .
707405 4/1954 United Kingdom .
1321961 7/1973 United Kingdom .

*Primary Examiner*—Joseph J. Rolla
*Assistant Examiner*—Michael S. Huppert
*Attorney, Agent, or Firm*—McAulay, Fields, Fisher, Goldstein & Nissen

[57] ABSTRACT

A food vending machine having a selection station, a magazine for a plurality of refrigerated or unrefrigerated portioned food items, a heating apparatus, a serving station and a conveying apparatus between the magazine and reheating apparatus. The magazine is disposed in a supply cabinet (11) which is separable from a serving cabinet (12) containing the reheating apparatus, the serving station (21) and the conveying apparatus in order to improve the hygenic operation of the vending machine (10), while simultaneously reducing the refrigeration demand and increasing the serving speed.

23 Claims, 16 Drawing Figures

FOOD VENDING MACHINE

The invention relates to a food vending machine with a magazine for a plurality of refrigerated or unrefrigerated portioned food items, a reheating apparatus, a serving station, a conveying apparatus between the magazine and reheating apparatus as well as a selection station whereby the magazine is disposed in a supply cabinet which is separable from a serving cabinet containing the reheating apparatus and the serving station.

Such a food vending machine is known from United Kingdom Patent Specification No. 1,321,961.

The known food vending machine exhibits a thermally insulated supply cabinet which is provided with a refrigerating unit. The supply cabinet is divided into several, for example five, juxtaposed magazines whereby each magazine contains one specific kind of food item. For each magazine there is a switch accessible to the user on the front of the vending machine, by means of which switch the user, for example after inserting a suitable coin, can select a specific magazine and thus a specific food item. Furthermore, each magazine has a setting apparatus inaccessible to the user by means of which a reheating time can be individually set for each magazine. Consequently, in the aforementioned example, five different food items can be offered in the food vending machine whereby the identical food items contained in a magazine each have a specific, identical reheating time.

The supply cabinet of the known vending machine is fixed in place. Situated inside it in addition to the magazines is a conveying apparatus. A first part of the conveying apparatus moves vertically disposed magazine racks in a vertical direction until the bottom-most food dish comes into the area of a conveying belt which conveys the dish into the rear area of the supply cabinet. Here, the dish is put onto a common, transversely disposed conveying belt and passes through a door which opens in an outer wall of the supply cabinet in order to reach a reheating apparatus.

The reheating apparatus is in the form of a movable unit with a microwave oven which can be moved laterally into a continuation of the housing of the supply cabinet.

Apart from the means required for passing through the microwave oven which are usually in the form of a chute or similar, the reheating apparatus contains no conveying apparatus.

The known food vending machine thus has some important operational disadvantages:

If it is desired, for example, to load the known food vending machine with food items, it must be completely opened by swinging up a glass plate disposed on the front of the supply cabinet and food items are then deposited individually in the respective compartments. The vending machine cannot be used during this relatively long refilling operation.

A further disadvantage is that the magazines with the food items and the conveying apparatus are disposed jointly inside the supply cabinet and must be refrigerated together. This may result in problems of hygiene because the conveying apparatus may soil the food items; furthermore, the operation of the conveying apparatus always generates a certain degree of heat which must likewise be removed by the refrigerating unit.

Finally, the known food vending machine operates only sequentially, i.e. from the arrival of a first user through selection of the food item, conveying and reheating down to the serving of the food item, only this one operation is processed and a second user cannot move into action until the first user has been completely served.

In other known food vending machines of the kind that have become known through DE-OS No. 24 43 200, DE-OS, No. 25 29 870 and US-PS No. 4 398 651, these aforementioned problems are present to an even greater extent because, in these known food vending machines, all the equipment is accommodated in a common housing.

Finally, another food vending machine is known from GB-PS No. 707 405 which exhibits a revolving, thermally insulated food magazine which is rotatable about a vertical axis and from which food items can be removed in a downward direction through a chute. However, this known food vending machine is a vending machine which serves the food items, particularly ice cream, in a refrigerated state. Consequently, it is not subject to the problems which arise from the additional provision of a reheating apparatus.

Accordingly, the object of the invention is to design a food vending machine of the initially mentioned kind such that the time sequence for serving the food is accelerated while, in particular, the downtimes for magazining are reduced whereby, at the same time, the refrigeration demand is minimized, and, furthermore, absolute hygiene prevails.

The object of the invention is achieved in that the serving station further contains the selection station as well as the conveying apparatus and is fixed while the supply cabinet is in the form of an interchangeable unit.

These measures completely achieve the object of the invention because, since it is separate and interchangeable, the supply cabinet can be exchanged with just a few manual operations so that there are only extremely short downtimes when magazining. Furthermore, only the contents of the supply cabinet with the magazines and food items contained therein are refrigerated, and not any additional apparatuses. This means that the refrigeration can be limited to the absolutely necessary level. The separate supply cabinet, which contains no unnecessary units, also guarantees to a particular extent that no soiling whatsoever of the food items can occur because the critical apparatuses in this respect, particularly the conveying apparatus, are disposed in a separate cabinet.

In an embodiment of the invention, supply cabinet and serving cabinet are in the form of juxtaposed cabinets.

This has the advantage that the supply cabinet can be moved with particular ease independently of the serving cabinet, for example when the empty or almost empty supply cabinet is disconnected as a whole and is replaced by a full supply cabinet.

In addition, an embodiment is preferred in which supply cabinet and serving cabinet can be connected to each other by means of plug-and-socket connectors.

This has the advantage that the supply cabinet can be connected and disconnected with particular ease from the serving cabinet without it being necessary to release or fasten screw-type connections or similar.

In a further embodiment of the invention, the wall between supply cabinet and serving cabinet is closed except for at least one transfer opening.

This has the advantage of reducing to the absolute, necessary minimum the degree of connection between the two cabinets. This means, firstly, that the aforementioned hygienic conditions can be guaranteed and, secondly, the effective insulation of the supply cabinet against loss of refrigeration is possible.

Particularly preferred is an embodiment in which the transfer opening is part of a rolling slider.

This has the advantage that with merely one single opening of just the minimum size necessary for conveying a food dish it is possible to move to a multitude of positions along the displacement path of the rolling slider, both in the horizontal as well as in the vertical.

When, in a preferred embodiment of the invention, the rolling slider is movable in the vertical direction, it is possible for the food dishes to be disposed one on top of the other in at least one vertical removable shaft.

This has the advantage that, thanks to the height-variable opening, it is possible to move to all shaft positions whereby the removability of the shaft opens up a further possibility for loading the food vending machine because, instead of the entire supply cabinet, it is also possible to exchange merely one single shaft.

Although several rolling sliders each with one opening might be used side by side for moving to several juxtaposed shafts, an embodiment is preferred in which the shafts are rotatably disposed on a revolving magazine.

This has the advantage that merely one single opening in one rolling slider is necessary. Furthermore, there is the essential advantage that moving to a given position is accomplished by two different drive mechanisms, namely, on the one hand, by the vertical movement of the conveying apparatus and, on the other hand, by the turning of the revolving magazine. Since both motions can take place simultaneously, this noticeably shortens the overall time between moving to one vertical position in one shaft and another vertical position in another shaft.

In addition, an embodiment is preferred in which a drive for the revolving magazine is disposed in the serving cabinet and is connected to the revolving magazine by means of a plug-in driving connection.

This ensures in a particularly simple manner that, firstly, the parts of the drive which are critical as regards the necessary hygiene are disposed in the separate serving cabinet while, secondly, the plug-in driving connection guarantees the simple separability of the supply cabinet from the serving cabinet.

In a variant of this embodiment, a simple revolving magazine with a basically circular conveying track is replaced by a revolving magazine in the manner of a so-called rotary conveyor with an oval conveying track. Of course, the storage capacity of such a magazine is considerably greater than that of a simple revolving magazine because a rotary conveyor consists basically of a two-part circular magazine with two interposed tangential sections. Therefore, if the installation conditions allow and a higher capacity of the magazines is desired, such a rotary conveyor can also be used to advantage.

In a further embodiment of the invention, the serving cabinet exhibits a refrigerating apparatus which is connected to the interior of the supply cabinet by means of a plug-in nozzle.

This embodiment also provides the aforementioned advantages that the motor-driven units are disposed in the separate serving cabinet and thus separate from the food items without the advantages of the plug-in connection between the cabinets being lost.

In a further embodiment of the invention, the conveying apparatus is provided with a vertically movable platform and a conveying slider which can be moved out of the platform whereby the platform exhibits means for pulling with it the rolling slider.

This has the advantage that there is no need for separate driving means for the rolling slider, because the displacement of the rolling slider is accomplished simultaneously by the drive of the conveying apparatus.

The platform is movable preferably by means of at least one vertical spindle.

In a variant of a food vending machine according to the invention, the shaft, the conveying apparatus and a conveying belt leading to the reheating apparatus are disposed in a line.

This has the advantage that in one direction of motion the food dish is removed from the compartment by the conveying slider and is moved over the platform to the reheating apparatus in one single linear motion.

However, in another embodiment of the invention, the conveying unit may as a whole be swivellable about a vertical axis with the result that further degrees of freedom are possible for conveying the food dishes.

For example, the shaft, the conveying unit and the conveying belt leading to the reheating apparatus may be disposed at an angle of for example 90° to each other.

This has the advantage that there is a more compact arrangement of the elements in the serving cabinet whereby, however, the food dishes are moved "round the corner" by means of the swivellable conveying unit.

An embodiment of a food vending machine according to the invention is characterized by the fact that the supply cabinet is provided with an information and selection station 14, the serving cabinet being provided on the side toward the supply cabinet with a paying station and on the side away from the supply cabinet with the serving station. This has the advantage that three persons can move into action side by side at the vending machine—and in the logical sequence of operations. While one person at the information and selection station first of all studies the menu and then makes his/her selection, the second person can already be paying for the selected food items while, at the same time, the third person is waiting for the selected and paid-for food items to pass through the reheating station. Consequently, there is a kind of multiplex operation because the individual operations are intermeshed in contrast to the known vending machine where a user of the vending machine occupies the latter for the whole of the time during which he is selecting, paying and waiting for the food to be reheated. It is obvious that the invention with its intermeshed mode of operation between the three stations for selecting/paying-/serving provides a considerable increase in the throughput rate and thus faster serving of the users of the vending machine. This leads, for example in work breaks, to a considerably faster serving of the food items and thus to a reduction in the undesired and, above all, unpopular waiting times before the food is served.

In a further embodiment of the invention, a central information and selection station and at least two serving stations disposed to the side of the later are provided whereby an indicator points the way to the currently activated serving station.

This too has the advantage that the serving rate is increased because, unlike the previously depicted embodiment, the steps of selecting/paying/serving are not executed sequentially, but are split up whereby the step which takes longest, namely the reheating of the food items, is duplicated so that this results in a very high throughput rate.

Preferably, paying stations are provided between the central station and the serving stations.

This duplication of the paying stations also leads to a further acceleration of the serving of the food.

Preferably, the information and selection station may be in the form of a projecting console and the paying stations be preferably disposed on the sides of the console.

As regards procedure, this also has the advantage of accelerating the serving of the food because the stream of users in front of the console splits to right and left and it may be the case, for example, that on one side of the console a lengthy operation is executed for an extensively selected meal while on the other side of the console in the same time, for example, several cold food items can be served one after the other.

In a further embodiment of the invention, the food vending machine is disposed in a wall to a kitchen whereby the wall facing the kitchen is provided with doors for loading the supply cabinet.

This has the advantage that the known bottleneck between kitchen and serving station/cashdesk is prevented because the supply cabinet acts as a buffer between kitchen and user. In contrast to conventional canteens in which the users have to line up first at the serving station and then at the cash desk, there is a considerably accelerated throughput. This applies particularly when compared to those canteens in which the food has first of all to be served by hand at the serving station.

In a further embodiment of the invention, it is also possible to dispose several vending machines side by side in a line if there is a corresponding quantitative demand for the serving of food items.

The invention is represented in the drawings and is explained in greater detail in the drawings with reference to specimen embodiments.

Figure 1:
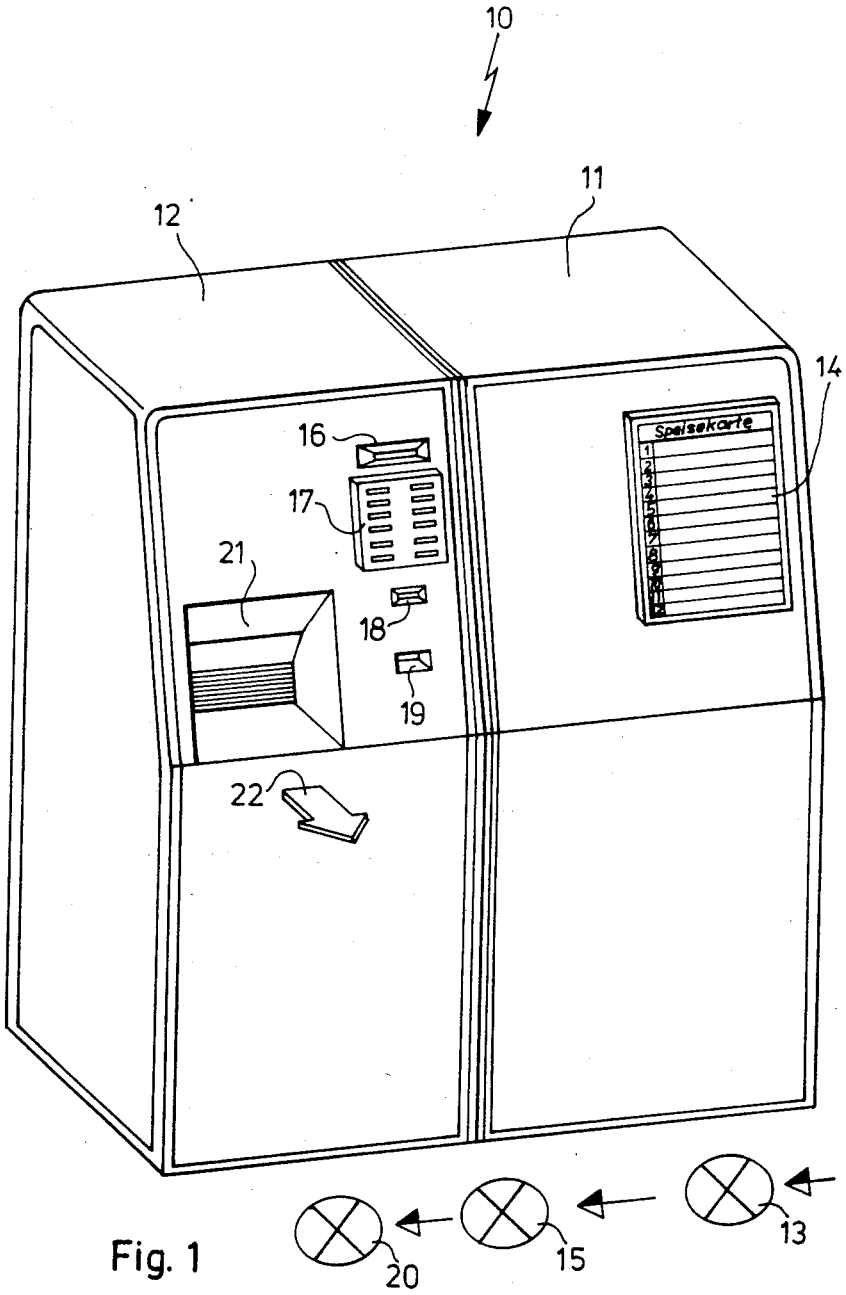
FIG. 1 shows a perspective view from the front of a first embodiment of a food vending machine according to the invention.
Figure 8:
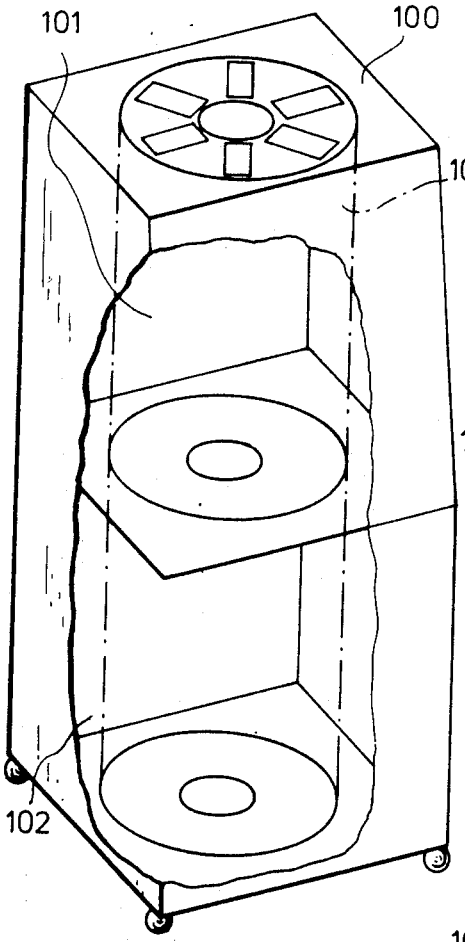
Figure 10:
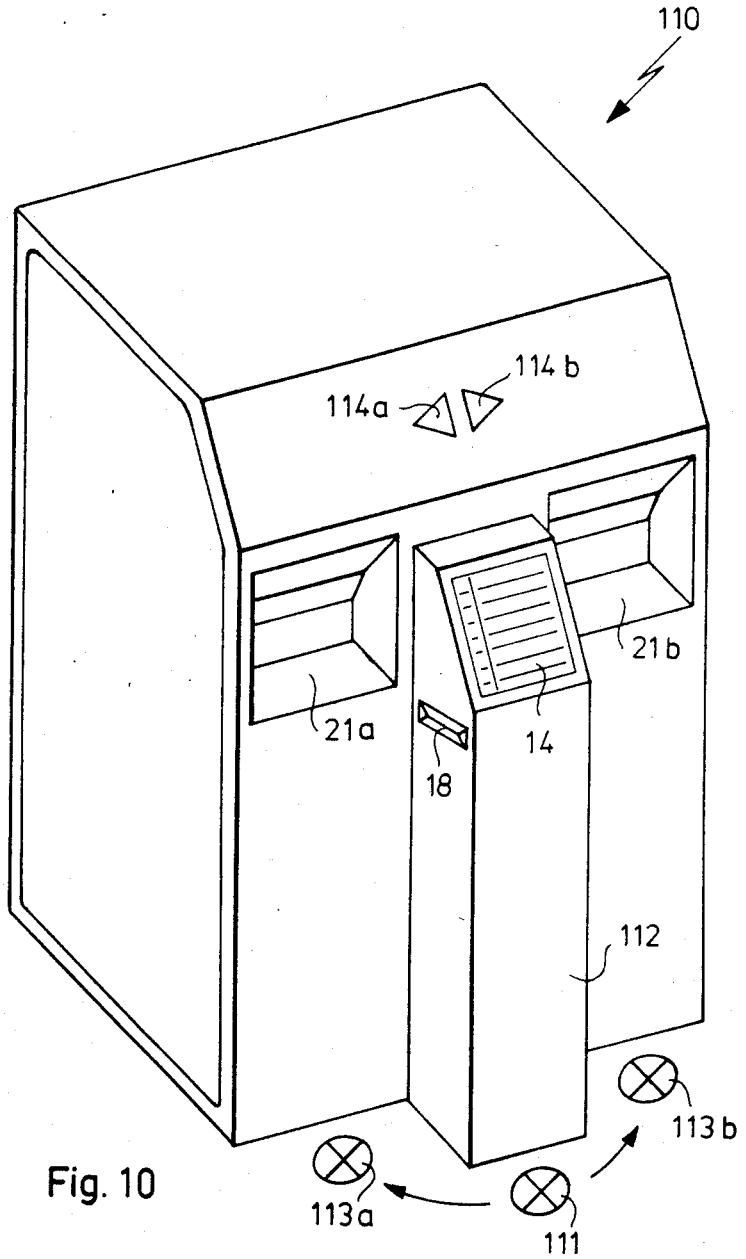
Figure 11:
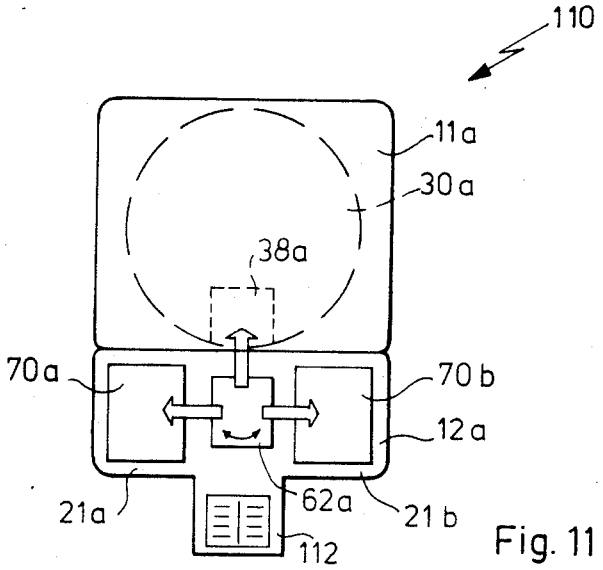
Figure 13:
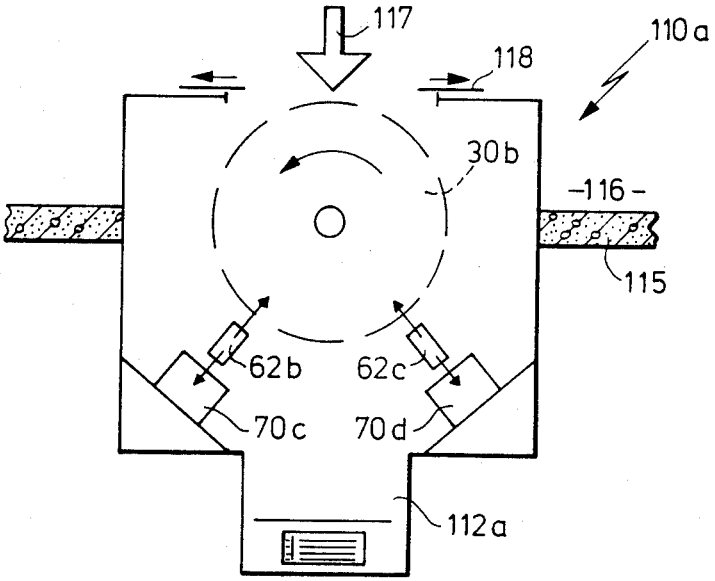
Figure 12:
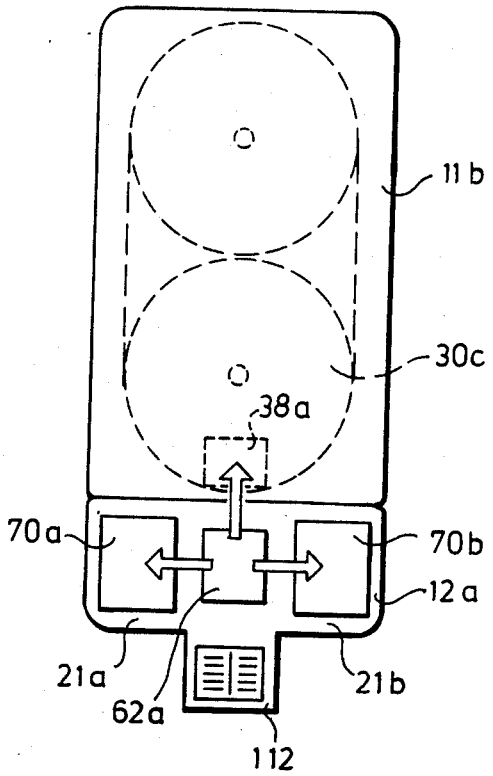
Figure 14:
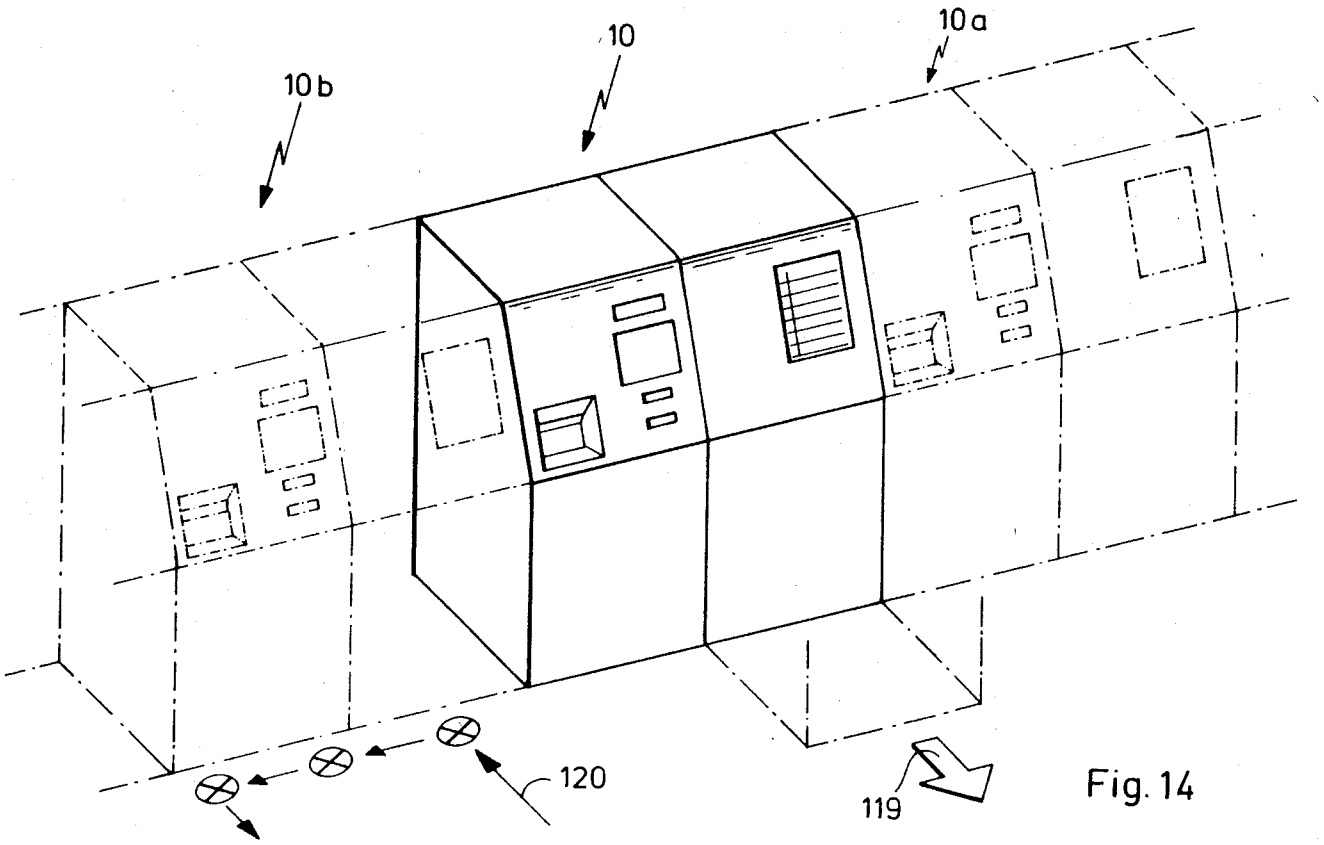

FIG. *7a* and *7b* show a detail view to explain the operating principle of conveying apparatus according to the invention;

FIG. 8 shows a perspective view from the front of a further specimen embodiment of a supply cabinet according to the invention;

FIG. *9a* shows a sectional representation through the supply cabinet as in FIG. 8;

FIG. *9b* shows a perspective view of a food vending machine with juxtaposed supply cabinets;

FIG. 10 shows a perspective view from the front of a further specimen embodiment of a food vending machine according to the invention;

FIG. 11 shows a diagrammatic view from above of the food vending machine as in FIG. 10;

FIG. 12 shows a variant of the specimen embodiment as in FIGS. 10 and 11 with a rotary conveyor as revolving magazine;

FIG. 13 shows a view from above of a further food vending machine intended for installation in a wall;

FIG. 14 shows a perspective view from the front of a line of food vending machines as in FIG. 1.

In FIG. 1 a first specimen embodiment of a food vending machine according to the invention is globally identified by 10. 11 is a supply cabinet and 12 a serving cabinet. The cabinets 11, 12 are connected together in a manner which is to be explained further below. The user of the food vending machine 10 finds himself initially in a first position 13 in which at an information and selection station 14 he can select from a menu one individual food item or a meal consisting of several individual food items.

After performing the selection operation, which can be executed with buttons or similar, the user goes to a second position 15 where an amount display 16 shows him the amount to be paid and a number display 17 shows him once again the meal or the individual food item he has selected. The user can now pay for the food item or the meal he has selected—either by means of a money slot 18 or a card slot 19 into which he can introduce a credit card or similar.

After completion of the paying operation, the user moves to a third position 20 where, from a serving shaft 21 in a direction 22, he receives the food item or meal he has selected.

It can be seen that thanks to the juxtaposition of positions 13, 15, 20 a line of users is also able to move past the food vending machine 10 whereby measures which are to be explained further below guarantee that the entire selection, paying and serving process takes place very quickly and thus efficiently.

Figure 2:
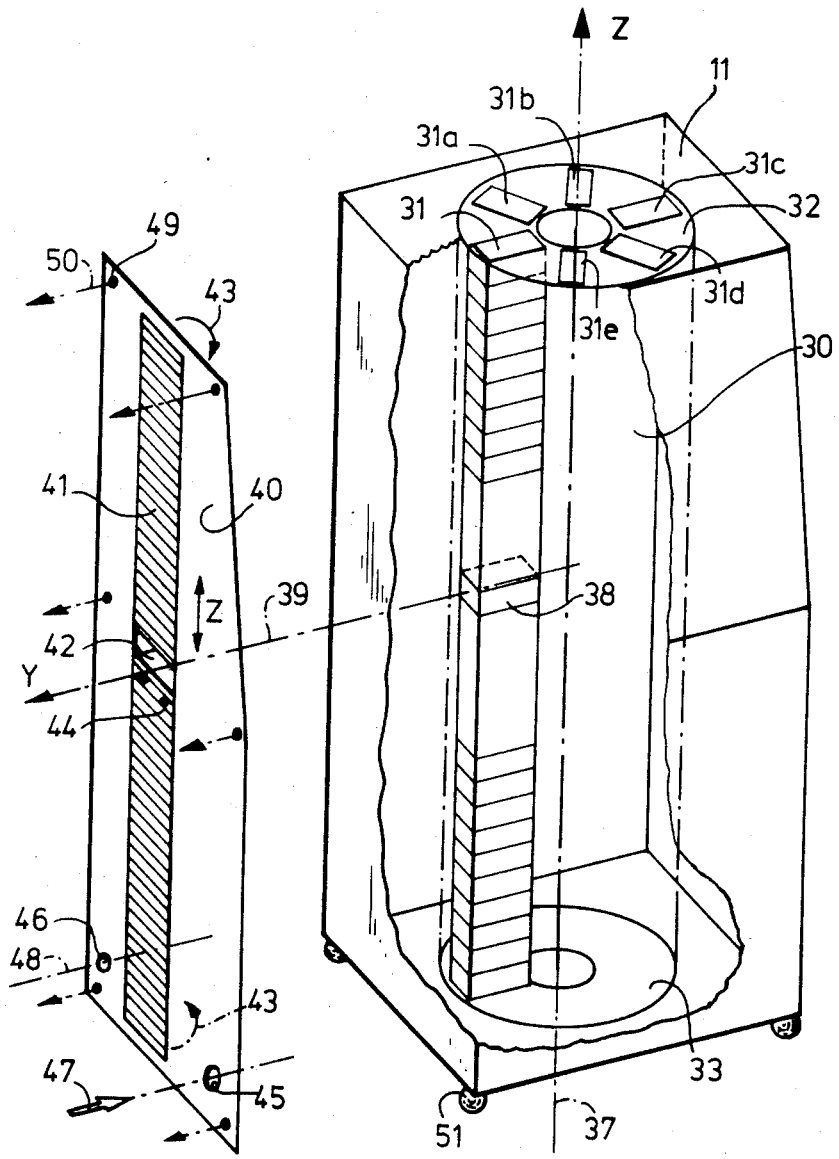
FIG. 2 shows a perspective view from the front, partially taken apart and cut away, of a specimen embodiment of a supply cabinet according to the invention.

FIG. 2 shows in detail the supply cabinet 11 with the side wall removed.

It can be seen that the food magazine in the supply cabinet 11 is in the form of a revolving magazine 30 in which are disposed in six radial directions six shafts 31, 31*a*, 31*b*, 31*c*, 31*d*, 31*e*, of which, for the sake of clarity, only shaft 31 is represented in detail. The shafts 31 to 31*e* are disposed between an upper turntable 32 and a lower turntable 33. The entire revolving magazine 30 is rotatable about a first z-axis 37. Each shaft 31 to 31*e* consists of a plurality of superimposed compartments; in shaft 31 one of these compartments is identified by 38. As will be shown further below with reference to FIG. 7, these compartments 38 contain individual portioned food items which can be removed from the compartment 38 in the direction of a y-axis 39.

The supply cabinet 11 is provided with a side wall 40 on the surface adjoining the serving cabinet 12. The side wall 40 has a rolling slider 41 whose height and width are so dimensioned that it aligns with the shaft 31 facing the side wall 40. The rolling slider 41 is provided with one single opening 42 which is just big enough so that a food item can be removed from the compartment 38.

The rolling slider 41 can be rolled up at the positions identified by 43 so that the opening 42 can be slid through from the top-most position of the shaft 31 to the bottom-most position. This is accomplished by sockets 44 which are driven by corresponding spigots of a conveying device, as will be explained later with reference to FIG. 3.

In total, this means that, apart from the very small opening 42, the supply cabinet 11 is enclosed on all sides so that, firstly, the temperature inside the supply cabinet 11 can be kept constant and, secondly, there is also no possibility of the food items stored in the supply cabinet 11 being soiled.

The intermediate wall 40 also has an opening 45 and a further opening 46 whereby the opening 45 is used for the connection of a refrigerating unit, as is indicated by an arrow 47, and the opening 46 serves as the lead-through for a shaft 48 which drives the revolving magazine 30. This will be explained in greater detail further below with reference to FIG. 5.

Finally, it can be seen from FIG. 2 that the supply cabinet 11 may be provided on the bottom side with rollers 51.

The loading of the supply cabinet 11 can be performed in three different manners.

Firstly, the individual compartments 38 can be refilled by hand, as required, through a further opening to be provided, for example, in the back of the supply cabinet 11.

Secondly, however, the shafts 31 to 31*e* can also each be removed as a whole and be replaced.

Finally, by means of the rollers 51 it is also possible for the entire supply cabinet 11 to be rolled away and replaced by another supply cabinet whose revolving magazine 30 is completely filled with food items. To open up this last-mentioned possibility, the rollers 51 as well as the openings 45 and 46 are provided which permit the connection of the supply cabinet 11 to the adjoining serving cabinet 12 in a direction identified by 50 in FIG. 2, for example by means of a spigot and socket connection.

Figure 3:
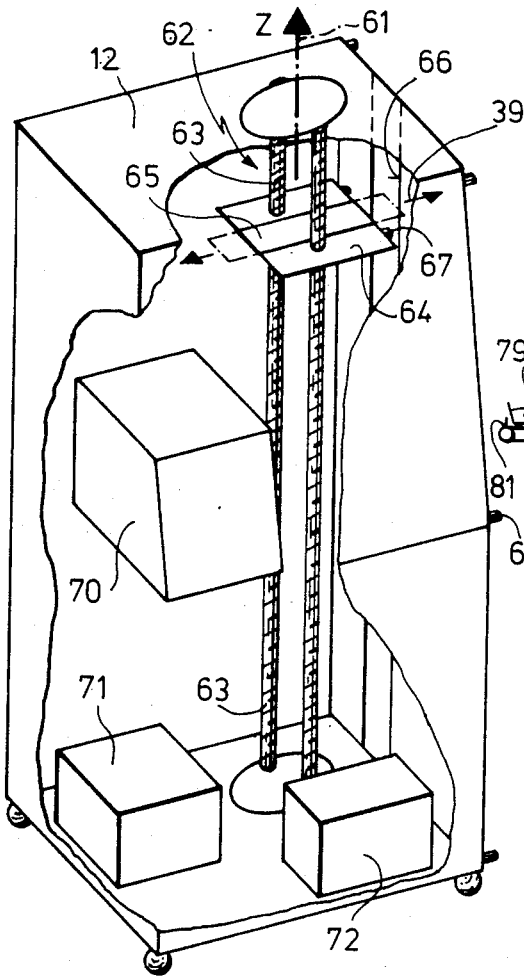
FIG. 3 shows a representation like FIG. 2, but for a specimen embodiment of a serving cabinet according to the invention.

In a similar representation, FIG. 3 shows in diagrammatic manner the interior of a serving cabinet 12.

On the right-hand wall of the serving cabinet 12 it is possible firstly to see spigots 60 which engage corresponding sockets of the supply cabinet 11 in the direction identified by 50 in FIG. 2.

Acting in the direction of a second z-axis 61 is a conveying apparatus 62 which is provided with two spindles 63 in order to be able to move a platform 64 in the z direction. A conveying slider 65, displaceable in the y-direction, is disposed on the platform 64. The conveying slider 65 is able to move into a cutout 66 which is disposed in the side wall of the serving cabinet 12 adjoining the supply cabinet 11 and whose contour corresponds to that of the rolling slider 41.

Furthermore, the platform 64 is provided with spigots 67 which engage the sockets 44 of the rolling slider 41. When the platform 64 is moved in the z-direction, therefore, the opening 42 of the rolling slider 41 is pulled along.

Furthermore, a reheating apparatus in the form of a microwave oven 70 is situated in the serving cabinet 12. This will be explained further below with reference to FIG. 4.

Finally, disposed at the base of the serving cabinet 12 are a drive 71 (indicated only schematically) as well as a refrigerating apparatus 72, as will be explained further below with reference to FIG. 5.

Figure 4:
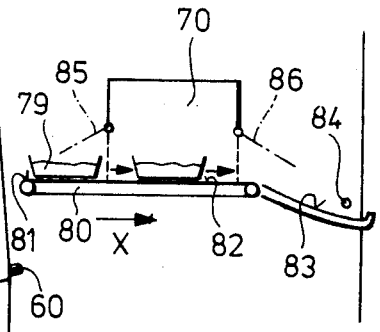
FIG. 4 shows a diagrammatic representation of a reheating apparatus according to the invention.

FIG. 4 shows in detail the reheating apparatus with the microwave oven 70.

It can be seen that a food dish 79, which has been removed from the compartment 38 by means of the conveying slider 65, is placed on a conveying belt 80 or another linear conveying unit and is in a waiting position 81 before the microwave oven 70. In a synchronized manner, doors 85, 86 of the microwave oven 70 open and close so that the food dish 79 moves into a heating position 82 inside the microwave oven 70. From here the food dish 79 is transferred across a transfer edge into a serving position 83, for example onto an inclined chute with a stop, whereby a photoelectric light barrier 84 guarantees that serving can take place only if the serving position 83 is not occupied by another food dish.

Figure 5:
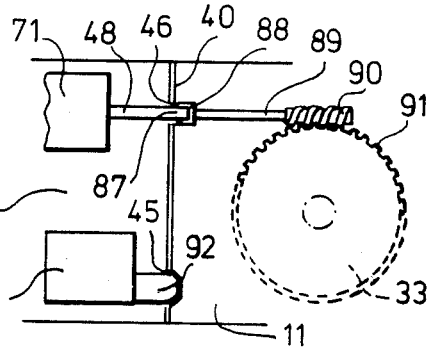
FIG. 5 shows a diagrammatic representation of the interaction of the supply cabinet as in FIG. 2 and the serving cabinet as in FIG. 3.

FIG. 5 shows in detail the interaction of supply cabinet 11 and serving cabinet 12. So that the two cabinets 11, 12 can easily be separated from each other, the end of the shaft 48 of the drive 71 is, for example, in the form of a profile end 87 which positively fits into a corresponding profile socket 88 of a shaft 89. The opposite end of the shaft 89 is provided with a worm gear 90 which meshes with teeth 91 on the circumference of the lower turntable 33. It goes without saying, however, that this driving connection is to be construed merely as an example. It is, of course, also possible to use other means of power transmission, clutch apparatuses etc. Nor is the drive of the turntable 33 in any way restricted to a worm gear drive.

FIG. 5 further shows that the opening 45 is conical in form so that a corresponding nozzle 92 of the refrigerating apparatus 72 can sealingly engage this opening 45 so that refrigerating air or another refrigerating medium is able to enter the interior of the supply cabinet 11.

FIG. 6 shows once again in a diagrammatic view from above the interaction of the cabinets 11, 12 in the area of the conveying apparatus 62. It can be seen that the food item is firstly removed from a corresponding compartment of the shaft 31 in the direction of an arrow 95 and is then brought to the waiting position 81 in the direction of a further arrow 96.

Figure 6:
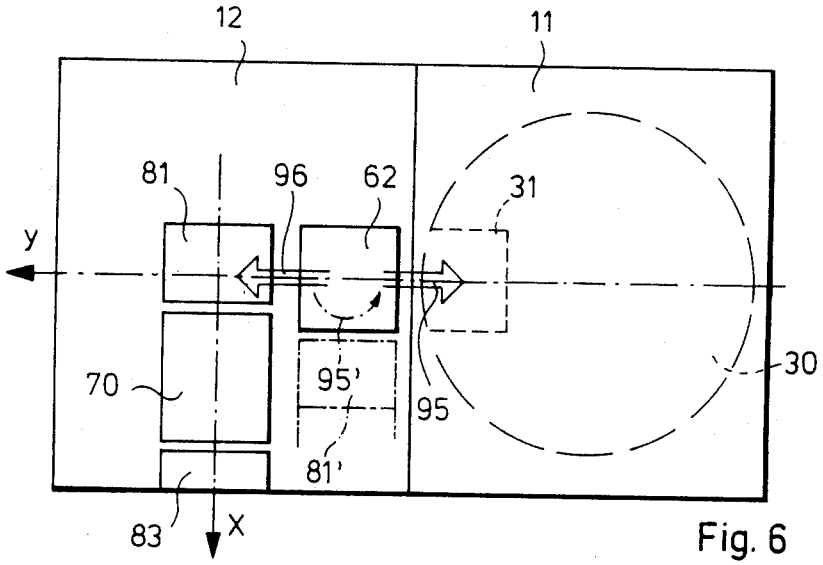
FIG. 6 shows a diagrammatic view from above of the food vending machine as in FIG. 1.

It goes without saying, furthermore, that the aforementioned arrangement may, for reasons of space, also be configured in such a way that the conveying apparatus 62 is rotatable in the direction of the arrow identified by 95′ so that the waiting position 81′ in FIG. 6 is not to the left of the conveying apparatus 62 but below it. Such rotation movement of conveying apparatus 62 in the direction of arrow 95′ may be accomplished by means of any conventional rotational drive as well as by the drive shown in FIG. 5 for rotation of lower turntable 33 forming part of revolving magazine 30.

In this manner it is possible to obtain a somewhat more compact construction.

Figure 7A:
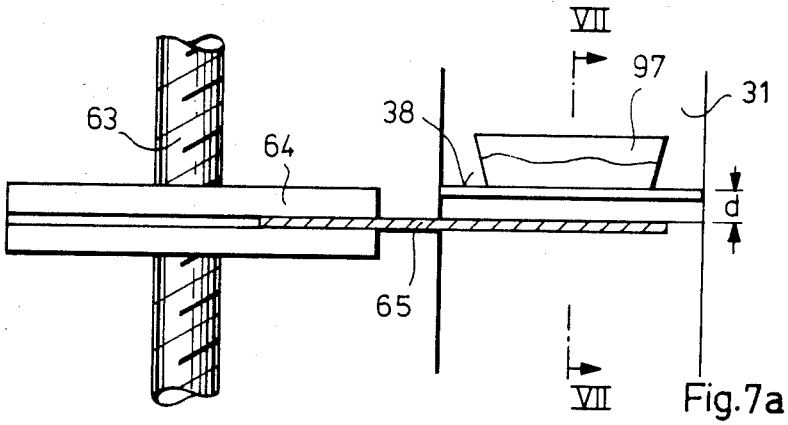
Figure 7B:
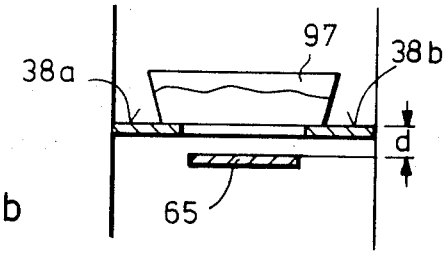

Finally, FIGS. 7*a* and 7*b* show details of the conveying apparatus.

FIG. 7*a* shows from the side that the platform 64 moves up to the compartment 38 initially with a preset negative underrun d in which position the conveying slider 65 is extended.

As can be seen from FIG. 7*b*, the food dish 97 rests merely by the lateral edges on corresponding rails 38*a*, 38*b* of the compartment 38 so that the conveying slider 65 can come from below under the food dish 67 and then—through upwardly moving the platform 64 by an amount somewhat greater than dimension d—can lift the food dish 97 off the compartment 38. The food dish 97 is now brought across the platform 64 into the waiting position 81, as shown in FIG. 6, and is there transferred in suitable manner, i.e. it is set down on lateral edges of the respective conveying apparatus, for example the conveying belt 80.

In the arrangement shown alternatively in FIG. 6 with a waiting position 81' it is also possible, for example, to use two parallel conveying belts which run side by side and which are configured in the manner of the rails 38*a*, 38*b* in FIG. 7*b*.

As regards the operation of the food vending machine 10 there apply the following practical considerations:

The supply cabinet 11 can hold for example 120 to 480 food dishes in the revolving magazine 30 with six shafts 31 to 31*e* and compartments of size 22×22×8 cm or 11×22×8 cm or 11×11×8 cm. It goes without saying that the compartments may be of different design, depending on whether plates, bowls or cups are used as food dishes.

Since efforts are centered on maximizing the speed with which the food is served and, if applicable, prepared, it will be practical first of all to assign each of the fixed shafts 31 to 31*e* a specific heating time, i.e. a maximum of 6 different heating times. In this manner, even during the selection operation the revolving magazine 30 can be moved by means of the drive 71 into the position in which that shaft is opposite the conveying apparatus 62 from which the food item is to be removed.

If a meal is selected, it can be ensured by means of suitable programming of a control unit of the food vending machine that the various food items of the meal are removed in such a way that minimum travel distances of revolving magazine 30 and/or conveying apparatus 62 are necessary. For reasons of simplicity all selected food items pass through the conveying belt 80, regardless of whether they are to be heated or not. In the case of those food items which are not to be heated, of course, the microwave oven 70 is not switched on when the food item is in the heating position 82. Furthermore, the control can be so programmed that, first of all, those food items which are not to be heated are passed through so that the time needed by the user to remove the cold food items from the serving position 83 is used for heating those food items which have to be heated.

This results overall in a considerable shortening of the time required between selecting and removing the food items because the time between selecting and paying is already used for moving the conveying apparatus into the preselected position. Of course, as far as the removal of the food item from the revolving magazine 30 is concerned, the conveying operation will not be performed until the selected food item has been paid for.

Figure 9A:
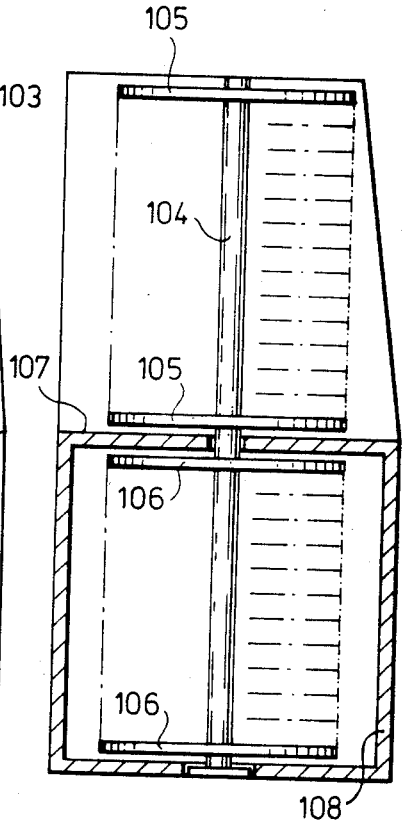

FIGS. 8 and 9*a* show a further variant of a supply cabinet according to the invention. It can be seen that the supply cabinet 100 is divided into two sections arranged one on top of the other; these are an upper refrigerating section 101 and a lower deepfreeze section 102.

For this purpose, a revolving magazine 103 with a vertical shaft 104 is provided whereby in the refrigerating section 101 the revolving magazine 103 is limited by two turntables 105 and in the deepfreeze section 102 by two turntables 106. The shaft 104 passes through the intermediate bottom 107 between refrigerating section 101 and deepfreeze section 102. The deepfreeze section 102 is provided overall with a thick insulation 108.

For the sake of clarity, the separately required deepfreeze refrigerating unit is not shown in FIGS. 8 and 9*a*. It may, for example, be disposed in the serving cabinet 12 similarly to the refrigerating apparatus 72.

Figure 9B:
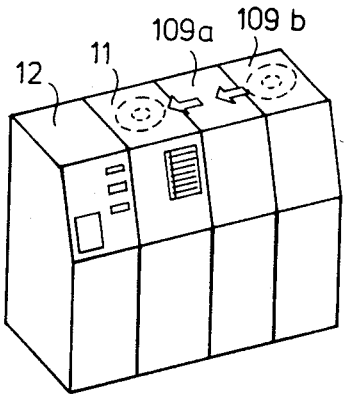

With the arrangement in FIGS. 8, 9*a* and 9*b* it is possible during the intervals to transfer food items from the deepfreeze zone into the refrigerating zone, i.e. intervals in which the removal of food items is not expected are used for rearranging.

For this purpose, the control provides for a refilling process to be triggered when the supply level in the refrigerating section 101 drops below a certain percentage.

The existing conveying apparatus 62 is used for conveying from the deepfreeze section 102 to the refrigerating section 101, and the deep-frozen food items are first of all heated in the microwave oven 70 to the temperature prevailing in the refrigerating section 101, i.e. as a rule they are thawed.

It goes without saying that, instead of a vertically divided supply cabinet 100, it is also possible to provide two supply cabinets side by side, as shown in FIG. 9*b*, of which one (11) is as a whole in the form of a refrigerating section and the other (109*b*) as a whole in the form of a deepfreeze section. Disposed between these two complete supply cabinets (11, 109*b*) may be a further separate thawing cabinet (109*a*) which handles the transfer from the deepfreeze supply cabinet (109*b*) to the refrigerating supply cabinet (11). In this case, the movements of the revolving magazines in the deepfreeze supply cabinet (109*b*,) and the refrigerating supply cabinet (11) can be synchronized so that each transfer takes place in a defined manner between the shafts of the two cabinets (11, 109*b*) through the thawing cabinet (109*a*).

FIG. 10 shows a further specimen embodiment of a food vending machine according to the invention which is identified by 110. In this variant, a high turnover rate is obtained by the fact that the construction is more compact and there are also two serving stations.

The user of the vending machine 110 moves initially into a first position 111 in front of a console 112 on which is disposed the information and selection station 14. After he has selected the food item or a meal consisting of several food items, an indicator 114*a* or 114*b* tells him whether the food item he has selected will be served on the left-hand or right-hand side of the vending machine 110. The user then moves into a second position 113*a* or 113*b* where at the laterally disposed paying station he can first of all insert the amount payable into a money slot 18 or similar. It is also possible for all elements 16 to 19 in FIG. 1 to be provided at this location.

The food items can now be removed by the user from the respective serving shaft 21*a* or 21*b*.

FIG. 11 shows the internal construction of the food vending machine 110 in a view from above. It can be seen that the supply cabinet 11*a* with revolving magazine 30*a* and shaft 31*a* is disposed in the rear area of the vending machine 110 and is basically the same as the construction described in detail in FIG. 2.

However, the serving part 12*a* has a somewhat different design because two microwave ovens 70*a*, 70*b* are disposed side by side for serving the serving shafts 21*a*, 21*b*. The conveying apparatus 62*a* disposed in the center between the two microwave ovens 70*a*, 70*b* first of all accepts the food item from the compartment 38*a* and, by subsequently rotating through +90° or −90°, delivers it to one of the ovens 70*a* or 70*b*, depending on how the control directs the conveying operation, displaying this by means of the indicators 114*a* or 114*b*.

In the variant of the specimen embodiment of FIGS. 10 and 11 shown in FIG. 12, a single revolving magazine, as identified by 30*a* in FIG. 11, is replaced by a revolving magazine 30*c* in the manner of a rotary conveyor. As can readily be seen by a comparison of FIGS. 11 and 12, the storage capacity of the revolving magazine 30*c* is greater by the "tangential sections" than the capacity of the revolving magazine 30*a* in FIG. 11.

In the variant of this vending machine shown in FIG. 13, a form of installation has been selected in which the food vending machine 110*a* is disposed in a wall 115 to a kitchen 116. The back wall facing the kitchen 116 is provided with sliding doors 118 so that the revolving magazine 30*b* can be continuously loaded from the rear in the direction of an arrow 117. In this case, two conveying apparatuses 62*b*, 62*c* remove food items from the magazine 30*b* and transfer them into two microwave ovens 70*c* and 70*d* respectively. In this manner, a further increase of the working speed is possible because each oven 70*c*, 70*b* is assigned its own conveying apparatus 62*b*, 62*c* respectively.

In this case, the food items in the revolving magazine 30*b* act as a buffer between kitchen and user so that the continuous removal of food items by the users is possible and also the food items can be replenished as required in the direction of the arrow 117 without this hindering the serving of food to the users.

Finally, FIG. 14 shows in a perspective view that a food vending machine 10, and of course also the further variants 110, 110*a*, can be installed not only singly, but also in a line with further vending machines 10*a*, 10*b*. The supply cabinets 11 can then be pulled out forward in the direction of an arrow 119 and can be completely refilled so that there are only minimal replenishing times. With the arrangement in FIG. 14 the users will move past the vending machines 10, 10*a*, 10*b* along a direction 120 with the result that a largely continuous and fast serving rate can be guaranteed overall.

What is claimed is:

1. A food vending machine comprising:

a supply cabinet (11) in the form of an interchangeable unit and including a selection station (14) and a magazine (30) for a plurality of refrigerated or unrefrigerated portioned food items;

a serving cabinet (12) separate from said supply cabinet (11) and including a reheating apparatus (70) and a serving station (21);

in said serving cabinet (12), a conveying apparatus (62) betwen said magazine and said reheating apparatus; and a wall (40) associated with said supply cabinet (11) and positioned between said supply cabinet and serving cabinet (12) which is closed except for at least one transfer opening (42), and said transfer opening being part of a rolling slider (41).

2. Food vending machine as defined in claim 1, wherein said supply cabinet (11) and serving cabinet (12) are in the form of juxtaposed cabinets.

3. Food vending machine as defined in claim 1, wherein said supply cabinet (11) and seving cabinet (12) can be connected to each other by means of plug-and-socket conectors.

4. Food vending machine as defined in claim 1, wherein the rolling slider (41) is movable in the vertical direction.

5. Food vending machine as defined in claim 4, wherein food dishes (79, 97) are disposed one on top of the other in at least one vertical, removable shaft (31 to 31*e*).

6. Food vending machine as defined in claim 5, wherein the shafts (31 to 31*e*) are rotatably disposed on a revolving magazine (30, 103).

7. Food vending machine as defined in claim 6, wherein the revolving magazine (30*c*) is in the manner of a rotary conveyor with basically oval conveying track.

8. Food vending machine as defined in claim 6, wherein a drive for the revolving magazine (30, 103) is disposed in the serving cabinet (12) and is disposed with the revolving magazine (30, 103) in the supply cabinet (12) and is connected to the revolving magazine (30, 103) by means of a plug-in driving connection (87, 88).

9. Food vending machine as defined in claim 6, wherein, after the selection station has been actuated, the conveying apparatus (62) and the revolving magazine (30, 103) move immediately and simultaneously into the selected position whereby the food dish (79, 97) is removed from said position after actuating a paying station (16 to 19).

10. Food vending machine as defined in claim 1, wherein the serving cabinet (12) exhibits a refrigerating apparatus (72) which is connected to the interior of the supply cabinet (11) by means of a plug-in nozzle (92).

11. Food vending machine as defined in claim 1, wherein the conveying apparatus (62) is provided with a vertically movable platform (64) and the platform (64) exhibits means (44, 67) for pulling with it the rolling slider (41).

12. Food vending machine as defined in claim 11, wherein the platform (64) is movable by means of at least one vertical spindle (63).

13. Food vending machine as defined in claim 11, wherein the shaft (31), the conveying apparatus (62) and a conveying belt (80) leading to the reheating apparatus are disposed in a line.

14. Food vending machine as defined in claim 11, wherein the conveying apparatus (62) as a whole is swivellable about a vertical axis (61).

15. Food vending machine as defined in claim 14, wherein the shaft (31), the conveying apparatus (62) and a conveying belt (80) leading to the reheating apparatus are disposed at an angle of preferably 90° to each other.

16. Food vending machine as defined in claim 1, wherein the supply cabinet (11) is provided with an information and selection station (14), the serving cabinet (12) being provided on the side toward the supply cabinet (11) with a paying station and on the side away from the supply cabinet (11) with the serving station (21).

17. Food vending machine as defined in claim 1, wherein a central information and selection station (14) and at least two serving stations (21*a*, 21*b*) disposed to the side of the latter are provided whereby an indicator (114*a*, 114*b*) points the way to the currently activated serving station (21*a*, 21*b*).

18. Food vending machine as defined in claim 17, wherein paying stations are provided between the central information and selection station (14) and the serving stations (21*a*, 21*b*).

19. Food vending machine as defined in claim 17, wherein the information and selection station (14) is in the form of a projecting console (112) and the paying stations are disposed preferably at the sides of the console (112).

20. Food vending machine as defined in claim 1, wherein the food vending machine (110*a*) is disposed in a wall (115) to a kitchen (116) whereby the wall facing the kitchen (116) is provided with doors (118) for loading the supply cabinet.

21. Food vending machine as defined in claim 1, wherein more than one vending machines (10, 10*a*, 10*b*) are disposed in a line.

22. Food vending machine as claimed in claim 1, wherein the wall (40) is a side wall of said supply cabinet (11).

23. A food vending machine, comprising:

a supply cabinet (11) in the form of an interchangeable unit and including a selection station (14) and a magazine (30) for a plurality of refrigerated or unrefrigerated portioned food items;

a serving cabinet (12) separate from and independent of said supply cabinet (11) and including a reheating apparatus (70) and a serving station (21);

in said serving cabinet (12), a conveying apparatus (62) between said magazine and said reheating apparatus; and plug-and-socket connectors for connecting said supply cabint (11) and said serving (12) together.

* * * * *